US011214854B2

(12) United States Patent
Busch et al.

(10) Patent No.: US 11,214,854 B2
(45) Date of Patent: Jan. 4, 2022

(54) COPPER-BASED ALLOY FOR THE PRODUCTION OF BULK METALLIC GLASSES

(71) Applicant: Heraeus Deutschland GmbH & Co. KG, Hanau (DE)

(72) Inventors: Ralf Busch, Saarbrücken (DE); Alexander Elsen, Hanau (DE); Moritz Stolpe, Hanau (DE); Hans Jürgen Wachter, Groß-Zimmern (DE); Eugen Milke, Nidderau (DE)

(73) Assignee: Heraeus Deutschland GmbH & Co. KG, Hanau (DE)

( * ) Notice: Subject to any disclaimer, the term of this patent is extended or adjusted under 35 U.S.C. 154(b) by 0 days.

(21) Appl. No.: 16/639,236

(22) PCT Filed: Aug. 9, 2018

(86) PCT No.: PCT/EP2018/071580
§ 371 (c)(1),
(2) Date: Feb. 14, 2020

(87) PCT Pub. No.: WO2019/034506
PCT Pub. Date: Feb. 21, 2019

(65) Prior Publication Data

US 2020/0208243 A1 Jul. 2, 2020

(30) Foreign Application Priority Data

Aug. 18, 2017 (EP) ..... 17186878

(51) Int. Cl.

| | |
|---|---|
| ***C22C 30/04*** | (2006.01) |
| ***B22D 21/02*** | (2006.01) |
| ***C22C 1/02*** | (2006.01) |
| ***C22C 45/00*** | (2006.01) |

(52) U.S. Cl.
CPC ..... *C22C 30/04* (2013.01); *B22D 21/025* (2013.01); *C22C 1/02* (2013.01); *C22C 45/001* (2013.01)

(58) Field of Classification Search
None
See application file for complete search history.

(56) References Cited

U.S. PATENT DOCUMENTS 5,618,359 A 4/1997 Lin et al.
2006/0102315 A1* 5/2006 Lee ..... B22D 11/0697 164/463
2006/0231169 A1 10/2006 Park et al.
2009/0288741 A1* 11/2009 Zhang ..... C22C 30/04 148/561
2017/0101702 A1* 4/2017 Park ..... C22C 45/10

FOREIGN PATENT DOCUMENTS

| | | |
|---|---|---|
| CN | 1511970 | 7/2004 |
| CN | 103866156 | 6/2014 |
| CN | 104117672 | 10/2014 |
| KR | 20140130388 | 11/2014 |
| KR | 20150141103 A * | 12/2015 |

OTHER PUBLICATIONS

English Translation of KR 20150141103 (originally published Dec. 2015) from Espacenet.*
Calin et al., "Formation, thermal stability and deformation behavior of high-strength Cu-based bulk glassy and nanostructured alloys", Advanced Engineering Materials, 2005, 7(10), pp. 960-965.
El-Hadek et al., "Failure behavior of Cu—Ti—Zr-based bulk metallic glass alloys", J Mater Sci, 2009,44(4), pp. 1127-1136.
Garrett et al., "Effect of microalloying on the toughness of metallic glasses", Appl Phys Lett, 2012, 101(241913), pp. 1-4.
Li et al., "Effect of Sn addition on the glass-forming ability in (Cu40Ti30Ni15Zr10)(100-x)/95Snx (X = 0,2,4, 6, and 8) alloys", Scripta Materia, 2000, 42(10), pp. 923-927.
Lin et al., "Formation of Ti—Zr—Cu—Ni bulk metallic glasses", J Appl Phys, 1995, 78(11), pp. 6514-6519.
Wang et al., "Bulk metallic glasses", Materials Science and Engineering, 2004, R44, pp. 45-89.
International Search Report dated Nov. 26, 2018 for International Patent Application No. PCT/EP2018/071580.
Partial International Search Report dated Oct. 5, 2018 for International Patent Application No. PCT/EP2018/071580.
Partial European Search Report dated Feb. 15, 2018 for European Patent Application No. 17186878.
Chinese Office Action dated Feb. 2, 2021 for Chinese Patent Application 201880052813.1.
Office Action dated Jul. 16, 2021 for Counterpart Korean Patent Application 210-2020-7004348.
Office Action dated Aug. 13, 2021 for Counterpart Chinese Patent Application 201880052813.1.
Liu et al., "Optimized Compositions of Ti(Cu,Ni)—Sn Alloy for Metallic Glass Formation and Their Correlation with Eutectic Reaction", Acta Metallurgica Sinica, 2008, 44(12), pp. 1424-1430.

* cited by examiner

*Primary Examiner* — George Wyszomierski
(74) *Attorney, Agent, or Firm* — Stradley Ronon Stevens & Young, LLP

(57) ABSTRACT

The present invention relates to an alloy which has the following composition:

$$Cu_{47at\,\%-(x+y+z)}(Ti_aZr_b)_cNi_{7at\,\%+x}Sn_{1at\,\%+y}Si_z$$

where
c=43-47 at %, a=0.65-0.85, b=0.15-0.35, where a+b=1.00; x=0-7 at %;
y=0-3 at %, z=0-3 at %, where y+z≤4 at %.

16 Claims, No Drawings

COPPER-BASED ALLOY FOR THE PRODUCTION OF BULK METALLIC GLASSES

CROSS REFERENCE TO RELATED APPLICATIONS

This application is a U.S. national phase filing of International Patent Application Number PCT/EP2018/071580 filed Aug. 9, 2018 that claims the priority of European Patent Application Number 17186878.9 filed Aug. 18, 2017. The disclosures of these applications are hereby incorporated by reference in their entirety.

BACKGROUND

Metallic glasses (also referred to as amorphous metals) have very high strengths. Furthermore, they display only a very small volume change, if any, on solidification, so that the possibility of near-net-shape molding without solidification shrinkage is opened up.

When metallic glasses having dimensions of at least 1 mm×1 mm×1 mm are able to be produced using an alloy, these glasses are also referred to as bulk metallic glasses ("BMG").

Owing to their advantageous properties such as a high strength and the absence of solidification shrinkage, metallic glasses, in particular bulk metallic glasses, are very interesting materials of construction which are in principle suitable for the production of components in mass production processes such as injection molding, without further treatment steps being absolutely necessary after shaping has been carried out.

To prevent crystallization of the alloy on cooling from the melt, it is necessary to exceed a critical cooling rate. However, the greater the volume of the melt, the more slowly the melt cools (under otherwise unchanged conditions). If a particular specimen thickness is exceeded, crystallization occurs before the alloy can solidify amorphously.

A measure of the glass formation capability of an alloy is therefore, for example, the maximum or "critical" diameter up to which a test specimen cast from the melt still has an essentially amorphous structure. This is also referred to as critical casting thickness. The greater the diameter of the still amorphously solidifying test specimen, the greater the glass formation capability of the alloy.

Apart from the excellent mechanical properties of metallic glasses, unique processing possibilities also arise from the glass state. Thus, metallic glasses can not only be shaped by melt-metallurgical processes but also be shaped by means of thermoplastic forming at comparatively low temperatures in a manner analogous to thermoplastic polymers or silicate glasses. For this purpose, the metallic glass is firstly heated to above the glass transition point and then behaves like a highly viscous liquid which can be molded hider relatively low forces. After shaping, the material is once again cooled to below the glass transition temperature.

A metallic glass can, depending on the use, be subjected at least temporarily to an elevated temperature which is sometimes even above the glass formation temperature $T_g$. As already mentioned above, thermoplastic forming also comprises heating of the metallic glass to a temperature above the glass formation temperature $T_g$. In these cases, it is desirable that there is a difference as great as possible between glass formation temperature $T_g$ and crystallization temperature $T_x$ (i.e. a very high value for $\Delta T_x = T_x - T_g$). The higher this $\Delta T_x$ value, the greater is, for example, the "temperature window" for thermoplastic forming and the smaller the risk of undesirable crystallization when the metallic glass is temporarily subjected to a temperature above $T_g$.

An improved glass formation capability of an alloy on cooling from the melt does not automatically lead to an improved heat resistance (i.e. a higher $\Delta T_x$ value) of the metallic glass consisting of this alloy. These are usually parameters which are independent of one another and can even run contrary to one another. When it is intended to provide an alloy with a very high $\Delta T_x$ value, therefore, care has to be taken to ensure that this does not occur at the expense of the glass formation capability on cooling from the melt.

Many alloy systems such as noble metal-based, Zr-, Cu- or Fe based alloys which, can form metallic glasses are now known. An overview may be found in, for example, C. H. Shek et al., Materials Science and Engineering, R 44, 2004, pages 45-89.

The alloys which are presently used most frequently for producing metallic glasses are Zr-based alloys. A disadvantage of these alloys is the rather high price of zirconium.

U.S. Pat. No. 5,618,359 describes Zr- and Cu-based alloys for producing metallic glasses. The alloys contain at least 4 alloy elements. One of the Cu-based alloys has the composition $Cu_{45}Ti_{33.8}Zr_{11.3}Ni_{10}$ and can be cast to give an amorphous test specimen having a thickness of 4 mm.

W. L. Johnson et al., J. Appl. Phys., 78, No. 11, December 1995, pages 6514-6519, likewise describe Cu- and Zr-based alloys for producing metallic glasses. At dimensions of at least 1 mm, these are referred to as bulk metallic glasses. The Cu and Zr alloys each contain a total of 4 alloy elements (Cu, Zr, Ti and Ni). The best compromise between good glass formation capability on cooling from the melt and very high $\Delta T_x$ value is displayed by the alloy having the composition $Cu_{47}Ti_{34}Zr_{11}Ni_8$.

G. R. Garrett et al., Appl. Phys. Lett., 101, 241913 (2012), doi: 10.1063/1.4769997, state that the glass formation capability of the alloy $Cu_{47}Ti_{34}Zr_{11}Ni_8$ can be improved further by addition of small amounts of Si, optionally in combination with Sn. Proceeding from the base alloy $Cu_{47}Ti_{34}Zr_{11}Ni_8$, Ti was replaced by Si and Ni was replaced by Sn, so that the compositions $Cu_{47}Ti_{33}Zr_{11}Ni_8Si_1$ and $Cu_{47}Ti_{33}Zr_{11}Ni_6Si_1Sn_2$ were obtained.

US 2006/0231169 A1 describes alloys for the production of metallic glasses which can, inter aha, be Cu-based. The alloy produced in example 3 has the composition $Cu_{47}Ti_{33}Zr_7Ni_8Si_1Nb_4$. Proceeding from the alloy $Cu_{47}Ti_{34}Zr_{11}Ni_8$ then, Ti was replaced by Si and Zr was replaced by Nb. The alloy produced in comparative example 3 has the composition $Cu_{47}Ti_{33}Zr_{11}Ni_8Si_1$.

SUMMARY OF THE INVENTION

It is an object of the present invention to provide an alloy which has a very high $\Delta T_x$ value (i.e. a wide temperature window for thermoplastic forming) but does not achieve this at the expense of glass formation capability and can be produced inexpensively. The improved heat resistance should preferably also not have an adverse effect on other relevant properties such as the hardness.

The object is achieved by an alloy which has the following composition:

$$Cu_{47at\,\%-(x+y+z)}(Ti_aZr_b)_cNi_{7at\,\%+x}Sn_{1at\,\%+y}Si_z$$

where c=43-47 at %, a=0.65-0.85, b=0.15-0.35, where a+b=1.00;

x=0-7 at %;

y=0-3 at %, z=0-3 at %, where y+z≤4 at %;

wherein the alloy optionally contains oxygen in a concentration of not more than 1.7 at % and the balance is unavoidable impurities.

DETAILED DESCRIPTION OF EMBODIMENTS OF THE INVENTION

In the context of the present invention, it has been recognized that alloys having the above-defined composition have high $\Delta T_x$ values and thus improved heat resistance combined with a still good glass formation capability. The alloys of the invention are thus very suitable for, for example, thermoplastic forming.

Preference is given to y=0-2 at % and z=0-2 at %. Thus, when Si is present in the alloy its concentration is not more than 2 at % (e.g. 0.5 at %≤Si≤2 at %), with the proviso that the total concentration of Sn and Si is not more than 4 at %.

In a preferred embodiment, x=5-7 at % and y+z≤4. Particular preference is given to x=5-7 at %, y=0-2 at % and z=0 at %; or x=5-7 at %, y=0-2 at % and 0<z≤2 at % (more preferably 0.5<z≤2 at %).

As an alternative, it can also be preferred that x=0-<5 at % (more preferably x=0-3 at %), y=0-2 at % and z=0 at %; x=0-<5 at % (more preferably x=0-3 at %), y=0-2 at % and 0<z≤2 at % (more preferably 0.5<z≤2 at %), with in both cases preference being given to y+z≤4.

Preference is given to a=0.70-0.80 and b=0.20-0.30. The atomic ratio of Ti to Zr is defined by the values of a and b.

If the alloy of the invention contains oxygen, this is present in a concentration of not more than 1.7 at %, for example 0.01-1.7 at % or 0.02-1.0 at %.

The proportion of unavoidable impurities in the alloy is preferably less than 0.5 at %, more preferably less than 0.1 at %, even more preferably less than 0.05 at % or even less than 0.01 at %.

In an illustrative embodiment, the alloy of the invention has the following composition:

42-46 at % of Cu 28-40 at % of Ti, more preferably 30-38 at % of Ti, and 7-15 at % of Zr, where Ti and Zr are together present in a concentration in the range of 43-47 at %;

7-11 at % of Ni (more preferably 7-9 at % of Ni), 1-3 at % of Sn and optionally ≤2 at % of Si (e.g. 0.5 at %≤Si≤2 at %), where, if Si is present, the total concentration of Sn+Si is not more than 4 at %, wherein the alloy optionally contains oxygen in a concentration of not more than 1.7 at % and the balance is unavoidable impurities.

In a further illustrative embodiment, the alloy of the invention has the following composition:

36-42 at % of Cu, more preferably 37-41 at % of Cu;

28-40 at % of Ti, more preferably 30-38 at % of Ti, and 7-15 at % of Zr, where Ti and Zr are together present in a concentration in the range of 43-47 at %;

11-15 at % of Ni, 1-3 at % of Su and optionally ≤2 at % of Si (e.g. 0.5 at %≤Si≤2 at %), where, if Si is present, the total concentration of Sn+Si is not more than 4 at %, wherein the alloy optionally contains oxygen in a concentration of not more than 1.7 at % and the balance is unavoidable impurities.

The composition of the alloy can be determined by optical emission spectrometry using inductively coupled plasma (ICP-OEC).

The alloy of the invention preferably has a crystallization temperature $T_x$ and a glass transition temperature $T_g$ which satisfy the following condition:

$$\Delta T_x = T_x - T_g \geq 55^\circ \text{ C.}$$

Greater preference is given to $\Delta T_x \geq 64^\circ$ C. or even ≥67° C., e.g. $64 \leq \Delta T_x \leq 95^\circ$ C. or $67 \leq \Delta T_x \leq 90^\circ$ C.

The glass transition temperature $T_g$ and the crystallization temperature $T_x$ are determined by DSC (differential scanning calorimetry). The onset temperature is employed in each case. The cooling and heating rates are 20° C./min. The DSC measurement is carried out under an argon atmosphere in an aluminum oxide crucible.

The alloy is preferably an amorphous alloy. In a preferred embodiment, the alloy of the invention has a crystallinity of less than 50%, more preferably less than 25% or is even entirely amorphous. An entirely amorphous material displays no diffraction reflections in an X-ray diffraction pattern.

The proportion of crystalline material is determined by means of DSC as a ratio of maximum enthalpy of crystallization (determined by crystallization of an entirely amorphous reference sample) and the actual enthalpy of crystallization in the sample.

The invention further provides a process for producing the above-described alloy, wherein the alloy is obtained from a melt containing Cu, Ti, Ni, Sn and optionally Si.

The melt is preferably kept under an inert gas atmosphere (e.g. a noble gas atmosphere).

The constituents of the alloy can each be introduced in their elemental form (e.g. elemental Cu, etc.) into the melt. As an alternative, it is also possible for two or more of these metals to be prealloyed in a starting alloy and this starting alloy then to be introduced into the melt.

Cooling and solidification of the melt produce the alloy as solid or solid body.

The melt can, for example, be poured into a mold or subjected to atomization. Atomization enables the alloy to be obtained in the form of a powder whose particles have essentially a spherical shape. Suitable atomization processes are known to those skilled in the art, for example gas atomization (e.g. using nitrogen or a noble gas such as argon or helium, as atomizing gas), plasma atomization, centrifugal atomization or no-crucible atomization (e.g. a "rotating electrode" process (REP), in particular a "plasma rotating electrode" process (PREP)). A further illustrated process is the EIGA ("electrode induction melting gas atomization") process, namely inductive melting of the starting material and subsequent gas atomization. The powder obtained by atomization can subsequently be used in an additive manufacturing process or else be subjected to thermoplastic for ring.

Owing to the very good glass formation capability of the alloy of the invention, it can readily be obtained in the form of an amorphous alloy.

The present invention further provides a bulk metallic glass which contains or even consists of the above-described alloy.

The bulk metallic glass preferably has dimensions, of at least 1 mm×1 mm×1 mm.

The bulk metallic glass preferably has a crystallinity of less than 50%, more preferably less than 25% or is even entirely amorphous.

The production of the bulk metallic glass can be carried out by processes known to those skilled in the art. For example, the above-described alloy is subjected to an additive manufacturing process or thermoplastic forming or is poured as melt into a mold.

For the additive manufacturing process or thermoplastic forming, the alloy can, for example, be used in the form of a powder (e.g. a powder obtained by atomization).

Components having a complex three-dimensional geometry can be produced directly by additive manufacturing processes. The term additive manufacture is used to refer to a process in which a component is built up layer-by-layer by deposition of material on the basis of digital 3D construction data. A thin layer of the powder is typically applied to the building platform. The powder is melted by means of a sufficiently high energy input, for example in the form of a laser beam or electron beam, at the areas prescribed by the computer-generated construction data. The building platform is then lowered and a further application of powder is carried out. The further powder layer is once again melted and is joined to the underlying layer at the defined areas. These steps are repeated until the component is present in its final shape.

Thermoplastic forming is usually carried out at a temperature which is between $T_g$ and $T_x$ of the alloy.

The invention will be illustrated in detail with the aid of the following examples.

Examples

Inventive alloys E1-E8 whose respective composition is indicated in Table 1 below were produced. In the comparative examples, the alloys CE1-CE5 were produced.

The production conditions were identical in all examples and only the composition was varied.

The $\Delta T_x$ value (i.e. the difference between crystallization temperature $T_x$ and glass formation temperature $T_g$) and also the critical casting thickness $D_c$ of the alloys are reported in Table 1.

As already indicated above, the determination of the glass transition temperature $T_g$ and the crystallization temperature $T_x$ was carried out by DSC an the basis of the onset temperatures and at cooling and heating rates of 20° C./min.

The critical casting thickness $D_c$ was determined as follows:

A cylinder having a length of 50 mm and a particular diameter is cast. The determination of $D_c$ is carried out by parting of the specimen at about 10-15 mm from the gate mark (in order to exclude the heat influence zone) and XRD measurement at the parting position over the total cross section.

The production of the alloys was carried out in an electric arc furnace from pure elements by melting and remelting to give a compact body which was melted again and cast into a Cu chill mold.

TABLE 1

Composition of the alloys and $\Delta T_x$ and $D_c$ values thereof

| | Cu [at %] | Ti [at %] | Zr [at %] | Ni [at %] | Sn [at %] | Si [at %] | $\Delta T_x$ [° C.] | $D_c$ [mm] |
|---|---|---|---|---|---|---|---|---|
| CE1 | 47 | 34 | 11 | 8 | 0 | 0 | 43 | 4 |
| E1 | 45 | 34 | 11 | 8 | 2 | 0 | 56 | 7 |
| E2 | 45 | 35.8 | 9.2 | 8 | 2 | 0 | 56 | |
| E3 | 45 | 37.5 | 7.5 | 8 | 2 | 0 | 58 | |

TABLE 1-continued

Composition of the alloys and $\Delta T_x$ and $D_c$ values thereof

| | Cu [at %] | Ti [at %] | Zr [at %] | Ni [at %] | Sn [at %] | Si [at %] | $\Delta T_x$ [° C.] | $D_c$ [mm] |
|---|---|---|---|---|---|---|---|---|
| E4 | 41.5 | 34 | 11 | 11.5 | 2 | 0 | 64 | 6 |
| E5 | 39.8 | 34 | 11 | 13.2 | 2 | 0 | 68 | 5 |
| CE2 | 34.5 | 34 | 11 | 18.5 | 2 | 0 | 81 | 0.5 |
| CE3 | 48.5 | 34 | 11 | 4.5 | 2 | 0 | 47 | 5 |
| CE4 | 50.2 | 34 | 11 | 2.8 | 2 | 0 | 43 | 6 |
| E6 | 44.0 | 34 | 11 | 8 | 2 | 1 | 71 | 6 |
| E7 | 43.5 | 34 | 11 | 8 | 2 | 1.5 | 73 | 5 |
| E8 | 38.2 | 34 | 11 | 13.3 | 2 | 1.5 | 85 | 4 |
| CE5 | 42 | 34 | 11 | 8 | 2 | 3 | 62 | 0.5 |

The alloy of comparative example CE1 has the composition $Cu_{47}Ti_{34}Zr_{11}Ni_8$. If a small amount of the copper is replaced by Sn, a significant increase in the $\Delta T_x$ value occurs and the $D_c$ value also increases very substantially, see example E1. A change in the relative proportions of Ti and Zr also gives this improvement in the $\Delta T_x$ value compared to the starting alloy, see examples E2 and E3.

An increase in the Ni concentration (see examples E4 and E5) leads to a further improvement in the $\Delta T_x$ value and at the same time the $D_c$ value can be kept at a relatively high level. An excessively high nickel concentration leads to a significant decrease in the $D_c$ value (see comparative example CE2), while an excessively low Ni concentration leads to a significant decrease in the $\Delta T_x$ value (see comparative examples CE3 and CE4).

As examples E6-E8 show, the presence of Si leads to a further increase in the $\Delta T_x$ value, so that values of more than 70° C. (E6 and E7) or even more than 80° C. (E8) are obtained. The $D_c$ values are in these cases still at a sufficiently high level. Owing to the very high $\Delta T_x$ values, the alloys are particularly well-suited to thermoplastic forming. As comparative example CE5 shows, an excessively high total concentration of Sn+Si leads to a deterioration in the $\Delta T_x$ and $D_c$ values.

As the data in Table 1 show, high $\Delta T_x$ values can be achieved with the alloys of the invention (i.e. there is a wide temperature window for thermoplastic forming), while at the same time the critical casting thickness $D_c$ can also be kept at a sufficiently high level.

In addition, the Vickers hardness was determined at a test force of 5 kilopond (HV5) for the alloys of examples E1, E5 and E6.

TABLE 2

Vickers hardness of the alloys

| | HV5 |
|---|---|
| Alloy of example E1 | 600-640 |
| Alloy of example E5 | 590-612 |
| Alloy of example E6 | 610-630 |

The data of Table 2 show that the alloys of the invention also display good hardness values.

The invention claimed is:

1. An alloy which has the following composition:

$$Cu_{47at\,\%-(x+y+z)}(Ti_aZr_b)_cNi_{7at\,\%+x}Sn_{1at\,\%+y}Si_z$$

where c=43-47 at %, a=0.65-0.85, b=0.15-0.35, where a+b=1.00;

x=5-7 at %;

y=0-2 at %, z=0-2 at %, where y+z≤4 at %;

wherein the alloy optionally contains oxygen in a concentration of not more than 1.7 at % and the balance is unavoidable impurities.

2. The alloy of claim 1, wherein a=0.70-0.80 and b=0.20-0.30.

3. The alloy of claim 1, wherein z=0 at %.

4. A bulk metallic glass containing the alloy of claim 1.

5. The bulk metallic glass of claim 4 having dimensions of at least 1 mm×1 mm×1 mm.

6. The alloy of claim 2, wherein z=0 at %.

7. An alloy which has the following composition:

$$Cu_{47at\,\%-(x+y+z)}(Ti_aZr_b)_cNi_{7at\,\%+x}Sn_{1at\,\%+y}Si_z$$

where c=43-47 at %, a=0.65-0.85, b=0.15-0.35, where a+b=1.00;

x=1-<5 at %;

y=1-2 at %, z=0-2 at %, where y+z≤4 at %;

wherein the alloy optionally contains oxygen in a concentration of not more than 1.7 at % and the balance is unavoidable impurities.

8. The alloy of claim 7 wherein c=45, a=34/45, b=11/45, x=1, y=1, z=0.

9. The alloy of claim 7 wherein c=45, a=35.8/45, b=9.2/45, x=1, y=1, z=0.

10. The alloy of claim 7 wherein c=45, a=37.5/45, b=7.5/45, x=1, y=1, z=0.

11. The alloy of claim 7 wherein c=45, a=34/45, b=11/45, x=4.5, y=1, z=0.

12. The alloy of claim 7 wherein c=45, a=34/45, b=11/45, x=1, y=1, z=1.

13. The alloy of claim 7 wherein c=45, a=34/45, b=11/45, x=1, y=1, z=1.5.

14. The alloy of claim 7 wherein a=0.70-0.80 and b=0.20-0.30.

15. A bulk metallic glass containing the alloy as claimed in claim 7.

16. The bulk metallic glass as claimed of claim 15 having dimensions of at least 1 mm×1 mm×1 mm.

* * * * *